US006197707B1

(12) United States Patent
Weiter et al.

(10) Patent No.: US 6,197,707 B1
(45) Date of Patent: Mar. 6, 2001

(54) FLAME-RETARDING SUPPORT INLAY WITH IMPROVED ADHESION

(75) Inventors: Bertrand Weiter; Hans-Jürgen Profe, both of Bobingen; Monika Nagl, Augsburg; Peter Heidel, Bobingen, all of (DE)

(73) Assignee: Johns Manville International, Inc., Denver, CO (US)

( * ) Notice: Subject to any disclaimer, the term of this patent is extended or adjusted under 35 U.S.C. 154(b) by 0 days.

(21) Appl. No.: 09/149,731

(22) Filed: Sep. 8, 1998

(30) Foreign Application Priority Data

Jun. 8, 1998 (DE) ..... 198 25 497

(51) Int. Cl.[7] ..... B32B 27/04; B32B 27/12

(52) U.S. Cl. ..... 442/136; 442/138; 428/920; 428/921

(58) Field of Search ..... 442/136, 138; 428/920, 921

(56) References Cited

U.S. PATENT DOCUMENTS

| | | | | |
|---|---|---|---|---|
| 3,276,906 | * | 10/1966 | Nielson et al. | 117/136 |
| 3,336,153 | * | 8/1967 | Juda et al. | 117/68.5 |
| 3,916,057 | * | 10/1975 | Hatch et al. | 428/236 |
| 3,934,066 | * | 1/1976 | Murch | 428/248 |
| 4,013,476 | * | 3/1977 | Ueda et al. | 106/15 |
| 4,018,962 | * | 4/1977 | Pedlow | 428/245 |
| 4,079,158 | * | 3/1978 | Kennepohl et al. | 428/143 |
| 4,617,221 | * | 10/1986 | Von Der Chys | 428/139 |
| 4,812,349 | * | 3/1989 | Meulbeck | 428/138 |
| 5,094,780 | * | 3/1992 | Von Bonin | 252/606 |
| 5,171,629 | * | 12/1992 | Heidel et al. | 428/285 |
| 5,283,106 | * | 2/1994 | Seiler et al. | 428/198 |
| 5,462,588 | * | 10/1995 | Walters et al. | 106/18.21 |
| 5,721,281 | * | 2/1998 | Blount | 521/50 |
| 5,728,338 | * | 3/1998 | Kiser | 264/129 |
| 5,809,725 | * | 9/1998 | Cretti | 52/426 |
| 5,854,309 | * | 12/1998 | Blount | 523/179 |
| 6,000,189 | * | 12/1999 | Breuer et al. | 52/649.1 |

FOREIGN PATENT DOCUMENTS 195 20 314 12/1996 (DE) .

* cited by examiner

*Primary Examiner*—Terrel Morris
*Assistant Examiner*—Arti Singh
(74) *Attorney, Agent, or Firm*—Burns, Doane, Swecker & Mathis LLP

(57) ABSTRACT

An improved bituminized flame-retardant textile material is provided that effectively overcomes bitumin adhesion difficulties associated with products of the prior art wherein the flame-retardant present on the surface of a textile support interfers with and hinders the achievement of bitumin adhesion. An anti-flame agent is applied in a quantity of 20 to 100 grams per square meter over 30 to 90 percent of the upper surface of the textile support. The remaining portions of the upper-surface of the textile support are free of the anti-flame agent. It surprisingly has been found that the surface portions of the textile support that are free of the anti-flame agent provide areas for the achievement of optimum bitumin adhesion with the textile support while still making possible entirely satisfactory flame retardancy for the overall product.

10 Claims, No Drawings

FLAME-RETARDING SUPPORT INLAY WITH IMPROVED ADHESION

The present invention relates to a flame-retarding support inlay, in particular for bituminous strips, affording an improved adhesion of the bitumen to the support inlay.

DE-OS 195 20 314 discloses a flame-retarding support insert comprising at least one areal textile configuration and at least one pulverulent anti-flame material and/or an additive in powdered form, the anti-flame material and/or additive being fixed by means of a fusible polymer whose adhesion temperature lies below the softening temperature of at least the supporting fibers of the areal textile configuration.

The bitumen is then applied later to the side of the areal textile configuration that is already covered with the anti-flame material, so that in the bituminous strips obtained, the layer of anti-flame material is arranged between the bitumen and the areal textile configuration. In this way the adhesiveness of the bituminous layer applied later may be reduced, since it will not adhere as well to the anti-flame agent as to the textile directly.

The object of the present invention, then, consists in providing a flame-retarding support insert comprising an areal textile fabric with applied anti-flame layer, on which a bituminous layer applied later will adhere with almost or quite the same retention as to the areal textile configuration alone.

According to the invention, this object is accomplished in that the areal textile configuration, with a mean application of anti-flame agent, averaged, that is, over the entire surface area of the textile configuration, in the range from 20 to 100 g/m$^2$, exhibits a coverage between 30% and 90% of its surface area, i.e., the anti-flame agent is applied only to portions of the surface area, while the remaining portions of the surface area of the textile configuration remains wholly uncovered by the anti-flame agent.

The term 'areal textile configuration' is to be understood in its broadest sense. Hence it may pertain to any configurations of fibers, in particular of synthetic polymers, that have been produced by a surface-forming technology. Examples of such configurations are woven, knit and preferably laid, knotted and fleeced fabrics.

Among the fleeces of synthetic polymer fibers, spun fleeces, so-called "spunbonds," produced by random deposition of freshly fusion-spun filaments, are preferred. They consist of endless synthetic fibers of fusible polymer material. Examples of suitable polymer materials are polyamides, such as for example polyhexamethylene diadipamide, polycaprolactam, aromatic or partly aromatic polyamides ("aramide"), partly or wholly aromatic polyesters, polyphenylene sulfide (PPS), polymers with ether and/or keto groups, such as for example polyether ketones (PEK) and polyether ether ketone (PEEK), or polybenzimidazoles.

The anti-flame materials used are intumescent and/or gas-evolving anti-flame agents known in the prior art. Such flame, or anti-flame, materials are or contain in particular:

(i) Graphite, for example Sigraflex®, which expands with evolution of heat and releases fire-retarding gases (inflation graphite) and/or (ii) Phosphorus-nitrogen compounds, such as ammonium phosphates and polyphosphates obtainable under the trade name Exolit®, and/or (iii) Compositions containing carbon donors, such as for example starch plus pentaerythritol, optionally plus phosphorus-nitrogen compound(s), such as for example dicyanodiamide and/or diammonium phosphate;

(iv) Red phosphorus present in sprinklable form and optionally containing phosphates and waxes. Examples for this are such commercial products as Hostaflam® RP 681, 682 and 683.

Preferably the anti-flame or -fire material is applied in a quantity from 20 to 100 g/m$^2$ to the top of the areal textile configuration of synthetic polymer fibers, where the application of the anti-flame or -fire material may be performed before, simultaneously with or after the application of a fusible polymer functioning as adhesive. Especially preferred are anti-flame or -fire materials first activated above the usual temperatures of 180° C. in bituminizing.

The fusible polymer employed as adhesive has an adhesion temperature below the softening temperature of at least the supporting fibers of the areal textile configuration. In the event that the areal textile configuration of synthetic polymer fibers is a fusion-binder consolidated fleece material, the softening temperatures of the fusible polymer and of the binding fibers of the fusion-binder consolidated fleece material may alternatively be nearly equal or even overlap.

The fusible polymer may be applied in the form of powders, granulates, staple fibers, endless fibers, film or as areal textile configurations. Suitable fusible polymers are thermoplastic polymers or resins. As thermoplastic polymers, polyolefins such as polypropylene, polyethylene, as well as polyamides and polybutylene terephthalate and modified polyethylene terephthalates—using aliphatic dicarboxylic acids and isophthalic acid—are suitable. Preferably, the fusible polymer is applied in a quantity from 5 to 120 g/m$^2$, more preferably in a quantity from 10 to 40 g/m$^2$, to the top of the areal textile configuration of synthetic polymer fibers.

As resins, fusible Duramin-formaldehyde precondensates are suitable, capable of condensing to duromers. Especially preferred for the fixation of the anti-flame agent to the areal configuration are cross-linking resins, such as for example melamine, epoxide or phenolic resins or mixtures thereof.

Then the areal textile configuration of synthetic polymer fibers charged bearing the anti-flame material and/or additive and the fusible polymer are treated by evolution of heat and/or pressure up to the adhesion temperature of the fusible polymer, so that the anti-flame material and/or additive will adhere to the top of the areal textile configuration of synthetic polymer fibers.

By adhesion temperature is meant the temperature at which the fusible polymer will wet the support inlay and the anti-flame agent and/or additive, so that a sufficient retention of the anti-flame agent and/or additive to the support inlay will result, and subsequent operations, such as winding, or bituminizing, can proceed without detachment of the anti-flame agent and/or additive.

In a preferred embodiment, the anti-flame agent applied to the areal textile configuration forms a regular pattern. Specially preferred as such patterns are polygons, connected or completely separated from each other, such as for example triangles, squares or rhomboids. In another preferred embodiment, the anti-flame agent, instead of being applied in regular patterns, may be applied in the form of company logos or other messages. In a further preferred embodiment, finally, the anti-flame agent is disposed in the form of transverse, diagonal or lengthwise stripes.

The bitumen adhesion, substantially enhanced compared to the prior art, is obtained according to the invention in that the anti-flame agent covers only portions of the surface of the areal textile configuration, all told between 30% and 90%, while the remaining portions are uncovered and available for enhanced bitumen adhesion. Surprisingly enough, it has been found that the adhesion of bitumen to the areal textile configuration itself was still equal or nearly equal to the adhesion of bitumen to a support inlay not covered with anti-flame agent if the areal textile configuration was covered to the extent of 30% to 90% of its total area with anti-flame agent, the covered and uncovered portions being preferably present regularly distributed over the entire area.

The partial surface coverage according to the invention is preferably achieved in the form of a pattern by controlled disposition of the anti-flame agent. Although the anti-flame agent then no longer covers connected portions of area, but the coverage is interrupted by exposed portions of area, a sufficient anti-flame effect is nevertheless maintained.

The invention will now be illustrated in more detail in terms of the following examples.

EXAMPLE 1 (for comparison)

On a coating system of 1 m width, consisting of powder strewing means, infrared source and two water-cooled pressure cylinders placed one above the other, a polyester filament fleece material was homogeneously sprinkled all over with a mixture (1:1 by weight) of inflation graphite powder having a mean grain size from 0.1 to 0.3 mm and a phenolic Novolak adhesive powder modified with an organic compound containing epoxide.

The fleece material used was a needled filament fleece of polyester, consolidated with a chemical binder and having a weight per unit area of 160 g/m$^2$ (trade name Trevira® Spunbond Type 033).

On the fleece material, 85 g/m$^2$ of powder mixture was applied. The infrared source was adjusted with a radiation pyrometer to a surface temperature of 150° C. After passage through the pair of squeezing cylinders, the surface temperature was 35–45° C.

The coated support was processed on a conventional system to produce roofing and sealing strips. On the finished roofing and sealing strips, only a low adhesion of bitumen was found.

EXAMPLE 2

The experiment of Example 1 was repeated, except that the powder mixture of inflation graphite and adhesive was strewn on the fleece material in stripes. The coated stripes were 8 mm in width, and the uncoated, graphite-free stripes were 4 mm in width. The coated area was 67% of the total area. The powder used, as in Example 1, was a mixture of an inflation graphite having a mean grain size from 0.1 to 0.3 mm and the adhesive powder in a proportion of 1:1 by weight. The application of the mixture, averaged over the entire area, was 85 g/m$^2$, i.e. 85 g was distributed effectively on an area of 0.67 m$^2$, resulting in an application of 63 g/m$^2$ anti-flame agent for the coated stripes. A satisfactory adhesion of bitumen to the bituminized roofing strip was found.

What is claimed is:

1. A bituminized flame-retardant textile material exhibiting improved bitumen adhesion comprising:

(a) a textile support having an upper surface, (b) an anti-flame agent fixed to between 30 and 90 percent of the upper surface of said textile support in a quantity of 20 to 100 grams per square meter while leaving the remaining portions of the upper-surface wholly free of said anti-flame agent, and (c) a bitumen coating covering the area of entire upper surface of said textile support with direct adhesion of the bitumen coating being achieved with said upper surface of said textile support at those locations where said anti-flame agent is absent.

2. A bituminized flame-retardant textile material exhibiting improved bitumen adhesion according to claim 1 wherein said textile support is a spunbonded material.

3. A bituminized flame-retardant textile material exhibiting improved bitumen adhesion according to claim 1 wherein anti-flame agent is held in place on said upper surface of said textile support by a fusible polymer.

4. A bituminized flame-retardant textile material exhibiting improved bitumin adhesion according to claim 3 wherein said fusible polymer is present in a concentration of 5 to 120 grams per square meter of said textile support.

5. A bituminized flame-retardant textile material exhibiting improved bitumen adhesion according to claim 3 wherein said fusible polymer is present in a concentration of 10 to 40 grams per square meter of said textile support.

6. A bituminized flame-retardant textile material exhibiting improved bitumen adhesion according to claim 1 wherein said anti-flame agent is fixed to the upper surface of said textile support in a regular pattern.

7. A bituminized flame-retardant textile material exhibiting improved bitumen adhesion according to claim 1 wherein said anti-flame agent is fixed to the upper surface of said textile support in the configuration of polygons.

8. A bituminized flame-retardant textile material exhibiting improved bitumen adhesion according to claim 1 wherein said anti-flame agent is fixed to the upper surface of said textile support in the configuration of stripes.

9. A bituminized flame-retardant textile material exhibiting improved bitumen adhesion according to claim 1 wherein said anti-flame agent is fixed to the upper surface of said textile support in the configuration of a written message.

10. A bituminized flame-retardant textile material exhibiting improved bitumen adhesion according to claim 1 wherein said anti-flame agent is fixed to the upper surface of said textile support in the configuration of a logo.

* * * * *